US010718566B2

(12) United States Patent
Kim et al.

(10) Patent No.: US 10,718,566 B2
(45) Date of Patent: Jul. 21, 2020

(54) WASHSTAND FURNITURE

(71) Applicant: LG ELECTRONICS INC., Seoul (KR)

(72) Inventors: Jongseok Kim, Seoul (KR); Inhyung Yang, Seoul (KR); Ungje Jo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 99 days.

(21) Appl. No.: 15/915,401

(22) Filed: Mar. 8, 2018

(65) Prior Publication Data

US 2018/0259259 A1 Sep. 13, 2018

(30) Foreign Application Priority Data

Mar. 8, 2017 (KR) ..... 10-2017-0029735

(51) Int. Cl.

| | |
|---|---|
| ***F26B 9/06*** | (2006.01) |
| ***A47B 88/43*** | (2017.01) |
| ***E03C 1/14*** | (2006.01) |
| ***E03C 1/04*** | (2006.01) |
| ***E03C 1/32*** | (2006.01) |

(Continued)

(52) U.S. Cl.

CPC ..... *F26B 9/066* (2013.01); *A47B 88/43* (2017.01); *E03C 1/04* (2013.01); *E03C 1/14* (2013.01); *E03C 1/32* (2013.01); *F26B 3/04* (2013.01); *F26B 25/08* (2013.01); *E03C 2201/40* (2013.01); *E03C 2201/90* (2013.01)

(58) Field of Classification Search

CPC ..... A47B 88/40; A47B 88/43; A47B 88/423; A47B 88/427; E03C 1/02; E03C 1/04; E03C 1/14; F26B 9/066

USPC ..... 4/630

See application file for complete search history.

(56) References Cited

U.S. PATENT DOCUMENTS

| | | | |
|---|---|---|---|
| 2,175,329 | A | 10/1939 | Watt |
| 2,287,657 | A | 6/1942 | Wisckol |
| 4,146,405 | A | 3/1979 | Timmer et al. |

(Continued)

FOREIGN PATENT DOCUMENTS

| | | |
|---|---|---|
| CN | 1540253 | 10/2004 |
| CN | 1718144 | 1/2006 |

(Continued)

OTHER PUBLICATIONS

U.S. Office Action dated Aug. 30, 2019 issued in U.S. Appl. No. 15/915,480.

(Continued)

*Primary Examiner* — Huyen D Le

(74) *Attorney, Agent, or Firm* — Ked & Associates, LLP

(57) ABSTRACT

Washstand furniture is disclosed. The washstand furniture includes: a wash device including a wash bowl, a water supply assembly for supplying water to the wash bowl, and a drainage assembly for draining the water supplied to the wash bowl; an inner cabinet provided under the wash bowl, the inner cabinet having a space defined therein; a frame provided outside the inner cabinet for supporting the load of the wash device; an electrically operated module provided in the inner cabinet; a rail for moving the module provided in the inner cabinet; and a rail bracket for fastening the rail to the inside of the inner cabinet and for fixing the inner cabinet and the frame.

20 Claims, 10 Drawing Sheets

(51) Int. Cl.

| | |
|---|---|
| ***F26B 25/08*** | (2006.01) |
| ***F26B 3/04*** | (2006.01) |

(56) References Cited

U.S. PATENT DOCUMENTS

| | | | | |
|---|---|---|---|---|
| 5,522,411 | A | 6/1996 | Johnson | |
| 5,702,115 | A * | 12/1997 | Pool | A61G 12/001 280/47.35 |
| 5,727,579 | A | 3/1998 | Chardack | |
| 5,915,851 | A | 6/1999 | Wattrick et al. | |
| 5,934,298 | A | 8/1999 | Singh | |
| 6,802,578 | B1 * | 10/2004 | Lang | A47B 46/00 177/144 |
| 8,245,414 | B2 | 8/2012 | Watson et al. | |
| 8,283,812 | B2 | 10/2012 | Azancot et al. | |
| 8,991,067 | B2 | 3/2015 | Zielinski et al. | |
| 9,255,733 | B2 | 2/2016 | Bagwell et al. | |
| 9,887,562 | B2 * | 2/2018 | Racenet | H02J 7/0042 |
| 10,317,137 | B2 * | 6/2019 | Kim | F26B 9/066 |
| 2007/0151302 | A1 * | 7/2007 | Kendall | D06F 29/00 68/3 R |
| 2007/0157378 | A1 | 7/2007 | Kendall et al. | |
| 2008/0256826 | A1 | 10/2008 | Zarembinski | |
| 2009/0077827 | A1 | 3/2009 | Doh | |
| 2014/0366262 | A1 | 12/2014 | Flynn | |
| 2015/0252515 | A1 | 9/2015 | Henry et al. | |
| 2016/0128528 | A1 | 5/2016 | Stewen et al. | |

FOREIGN PATENT DOCUMENTS

| | | |
|---|---|---|
| CN | 101443506 | 5/2009 |
| CN | 203106911 | 8/2013 |
| JP | H02-307414 | 12/1990 |

OTHER PUBLICATIONS

U.S. Office Action dated May 31, 2019 issued in U.S. Appl. No. 15/915,193.

U.S. Office Action dated Oct. 5, 2018 issued in U.S. Appl. No. 15/915,216.

U.S. Notice of Allowance dated Oct. 19, 2018 issued in copending U.S. Appl. No. 15/915,236.

United States Office Action dated Sep. 13, 2019 issued in U.S. Appl. No. 15/915,332.

Chinese Office Action dated Oct. 31, 2019 issued in CN Application No. 201810191653.0.

Chinese Office Action (with English translation) dated Mar. 27, 2020 issued in CN Application No. 201810191193.1.

Chinese Office Action (with English translation) dated Mar. 27, 2020 issued in CN Application No. 201810191389.0.

* cited by examiner

WASHSTAND FURNITURE

CROSS-REFERENCE TO RELATED APPLICATIONS

This application claims priority under 35 U.S.C. § 119 to Korean Application No. 10-2017-0029735, filed on Mar. 8, 2017, whose entire disclosure is hereby incorporated by reference.

U.S. application Ser. Nos. 15/915,193; 15/915,364; 15/915,267; 15/915,332; 15/915,401; 15/915,480; 15/915,421; 15/915,216; 15/915,236, all filed on Mar. 8, 2018, are related and are hereby incorporated by reference in their entirety. Further, one of ordinary skill in the art will recognize that features disclosed in these above-noted applications may be combined in any combination with features disclosed herein.

BACKGROUND

1. Field

The present disclosure relates to washstand furniture that utilizes the space under a washstand, and more particularly to washstand furniture having a module received therein.

2. Background

A bathroom may typically have a relatively small storage space for receiving and storing bathroom goods. For this reason, furniture may be provided in above or under a washstand in order to provide a storage space. In general, washstand furniture (also referred to as a vanity or washstand) may provide storage space under a washstand or sink.

Since washstand furniture is a structure installed in a bathroom, which is generally humid, the washstand furniture may be frequently exposed to moisture, whereby the storage space in the washstand furniture and items stored therein may be easily contaminated by the water. In addition, water supply and drainage devices through which water flows are frequently provided in the washstand furniture. Consequently, the storage space in the washstand furniture may be easily contaminated due to water discharged from the water supply and drainage devices.

Furthermore, since the washstand furniture is provided under the washstand in order to support the washstand, the storage space in the washstand furniture may be easily deformed due to the load of the washstand or external impacts.

BRIEF DESCRIPTION OF THE DRAWINGS

The embodiments will be described in detail with reference to the following drawings in which like reference numerals refer to like elements, and wherein.

DETAILED DESCRIPTION

Exemplary embodiments of washstand furniture according to the present disclosure will be described with reference to the accompanying drawings.

Figure 1:
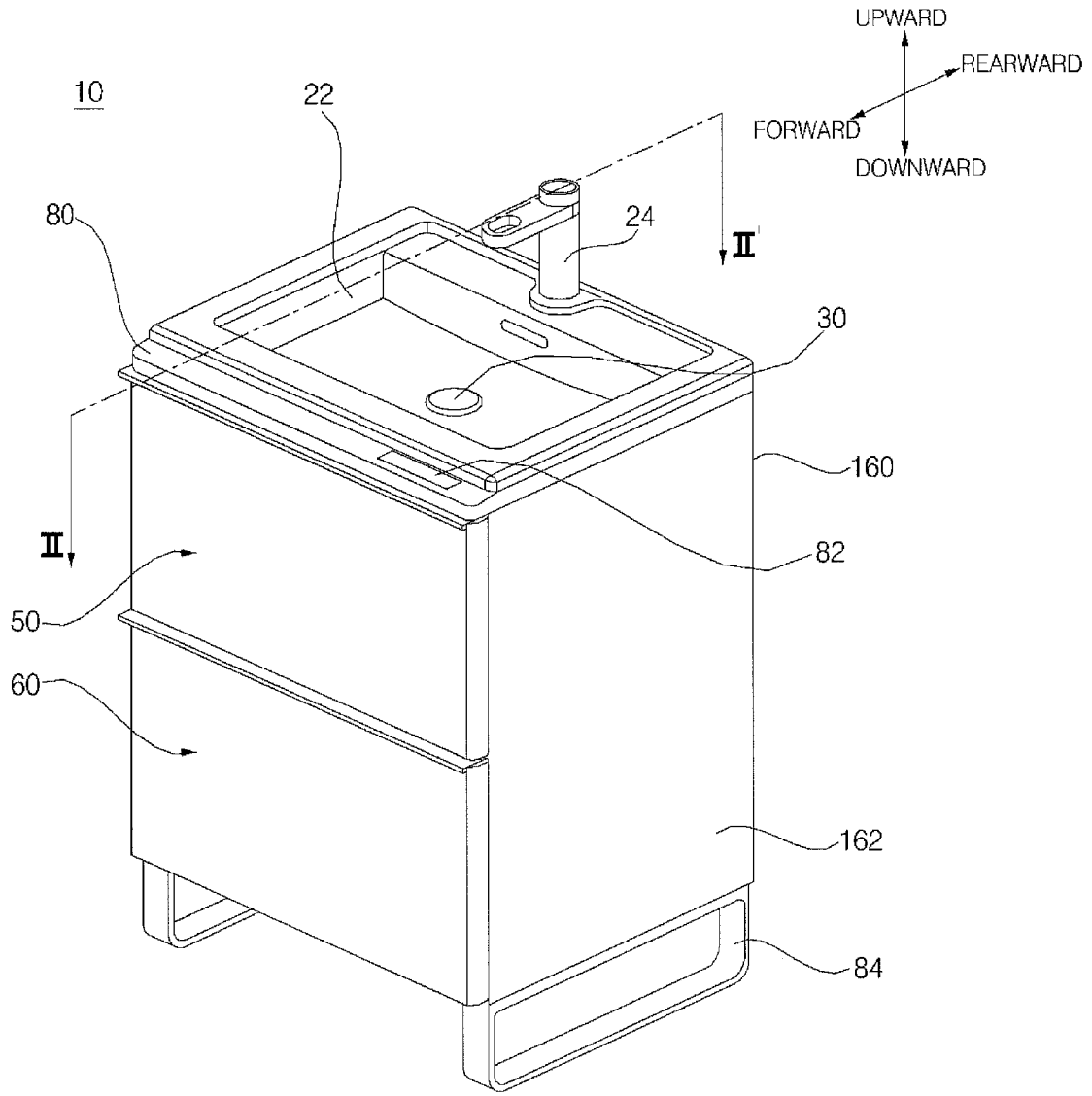
FIG. 1 is a perspective view showing washstand furniture according to an embodiment of the present disclosure.
Figure 2:
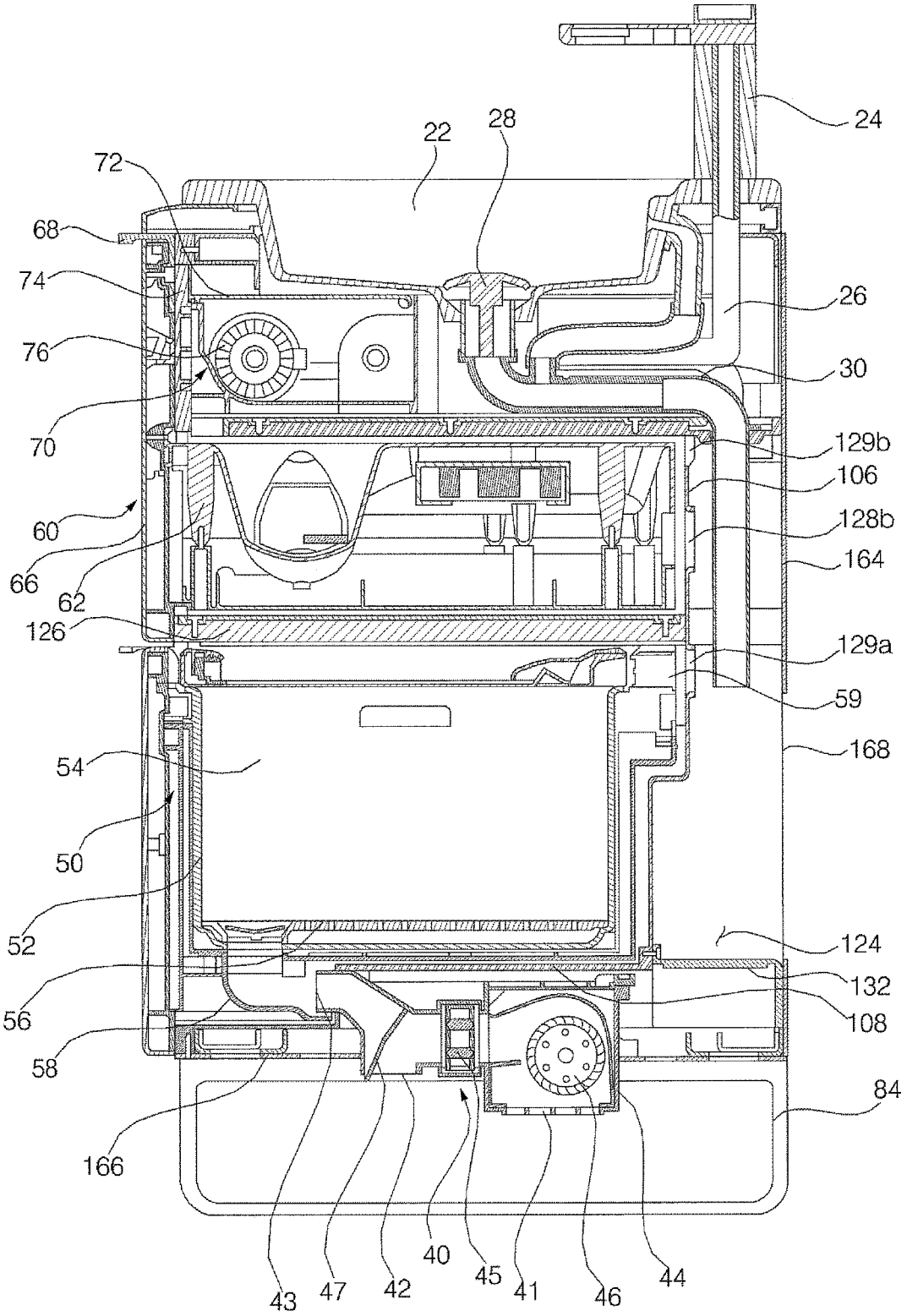
FIG. 2 is a sectional view taken along line II-II' of FIG. 1.

FIG. 1 is a perspective view showing washstand furniture according to an embodiment of the present disclosure, and FIG. 2 is a sectional view taken along line II-II' of FIG. 1. Hereinafter, the overall structure of the washstand furniture 10 according to this embodiment will be described with reference to FIGS. 1 and 2.

The washstand furniture according to this embodiment may include: a wash device including a wash bowl 22, a water supply assembly (also referred to as a faucet or tap) to supply water into the wash bowl, and a drainage assembly (or drain) to remove the water supplied to the wash bowl; an inner cabinet 100 provided under the wash bowl, the inner cabinet having a space defined therein; a frame 140 provided outside the inner cabinet that supports a load of the wash device; an electrically operated module provided in the inner cabinet; a rail 134 to move the module provided in the inner cabinet; and a rail bracket 200 that fastens the rail to an inside of the inner cabinet and to fix the inner cabinet and the frame.

Referring to FIG. 1, in the washstand furniture 10 according to this embodiment, the direction in which the module is withdrawn from the cabinet (e.g., opposite to a wall surface where the washstand furniture 10 is mounted) will be referred to as a forward direction, the direction opposite the forward direction (e.g., adjacent to the wall surface where the washstand furniture 10 is mounted) will be referred to as a rearward direction, the direction in which the wash bowl 22 is provided will be referred to as an upward direction, and the direction in which legs of the washstand furniture are provided will be referred to as a downward direction (e.g., opposite to the upward direction), but these directs are defined for convenience of description and are not intended to limit the scope of the disclosure (e.g., the module may be withdrawn from a side surface of the cabinet, and some or all of the cabinet may be mounted at a side or above the washbowl).

The wash device is a device that may be provided at the wall of a restroom, i.e. a washroom, to allow a user to wash his/her face or hands. The wash device may include a wash bowl (or basin) 22 that stores water to perform washing, a water supply assembly (or faucet) that supplies water to the wash bowl 22, and a drainage assembly (or drain) through which the supplied water is removed from the wash bowl 22.

An enamel wash bowl or a ceramic wash bowl may be used as the wash bowl 22. In this embodiment, an enamel wash bowl may be used, since the enamel wash bowl can be variably formed and the lower part of the enamel wash bowl can be easily coupled to the cabinet. The wash bowl 22 may be provided at the upper part of the washstand furniture 10.

The water supply assembly may include a water supply valve (also referred to as a faucet or a tap) 24 that controls the supply of water to the wash bowl 22 and a water supply hose 26 that supplies water to the water supply valve 24. The water supply valve 24 may be provided at one side of the wash bowl 22 to supply water to the wash bowl 22. The water supply hose 26 may include a hot water hose that supplies hot water and a cold water hose that supplies cold water.

The water supply assembly may further include a water purification filter 76 that purifies the water that is introduced into the water supply hose 26. The water purification filter 76 may purify the water that is discharged to the wash bowl 22 via the water supply valve 24.

The drainage assembly may include a drainage pipe 30 that discharges the water stored in the wash bowl 22 to the outside, and a popup valve 28 that selectively blocks the drainage pipe 30 to store the water in the wash bowl 22 or allow the water stored in the wash bowl 22 to move to the drainage pipe 30.

The cabinet, which defines the external appearance of the washstand furniture 10, may be provided under the wash device. The cabinet maintains the rigidity of the washstand furniture 10 and may include a space in which one or more modules are received. In this embodiment, the module received in the cabinet may be an electrically operated device. In this embodiment, the interior of the cabinet may be hollow to define a space to accommodate the module, and the front of the cabinet may be open to provide a path to receive the module.

In this embodiment, the cabinet may include an inner cabinet 100 to receive the module (or drawer assembly) therein and an outer cabinet 160 may be provided outside the inner cabinet 100 for maintaining the rigidity of the washstand furniture. The module provided in the washstand furniture 10 according to this embodiment may be divided into inner modules (or simply "modules") 50 and 60 provided in the inner cabinet 100 and an additional module 70 provided outside the inner cabinet (e.g., between the inner module 100 and the washstand bowl 22 or the outer cabinet 160).

In this embodiment, the washstand furniture 10 may include an inner cabinet 100 and an outer cabinet 160 such that water is doubly prevented from being introduced from the washbowl 22 and into the modules provided in the inner cabinet 100. The inner cabinet 100 and the outer cabinet 160 may be connected to each other via a frame 140 (see FIGS. 4 and 5). Hereinafter, the inner cabinet 100, the outer cabinet 160, and the frame 140, which constitute the structure of the washstand furniture 10, will be described in detail.

In this embodiment, the washstand furniture 10 may further include an air conditioner (or dryer) 40 that discharges air through a discharge port connected to the interior of the cabinet, to dry items received in a modules 50, 60. For example, a first module (or heated drawer assembly) 50 provided in the cabinet may dry utensils accommodated therein using the air discharged from the air conditioner 40, and a second module (or dryer drawer assembly) 60 provided in the cabinet may receive and dry separate components of a residual water suction device that is used to suction liquid from a surface of a bathroom. In this embodiment, the washstand furniture 10 may further include a third module (or controller drawer assembly) 70 provided between the cabinet and the wash bowl 22.

In this embodiment, the air conditioner 40, which is used in the washstand furniture 10, may discharge air to dehumidify the floor of the bathroom or to dry the interiors of the modules provided in the cabinet. The air conditioner 40 may discharge air through a first discharge port 42 facing the floor of the bathroom or through a second discharge port 43 connected to the interior of the cabinet using a fan 46.

In this embodiment, the air conditioner 40 may be provided under the inner cabinet 100. The air conditioner 40 may discharge air to the first module 50, which is provided in the inner cabinet 100, from under the inner cabinet 100. The air conditioner 40 may be provided under the lower surface of the inner cabinet 100. The air conditioner 40 may be positioned so as to be spaced apart from the floor of the bathroom by a predetermined distance. The air conditioner 40 may be spaced apart from the floor of the bathroom by a predetermined distance to discharge air toward the floor of the bathroom.

In this embodiment, the air conditioner 40 may include a housing 44 having therein a suction port 41, a first discharge port 42 to dry the floor of the bathroom, and a second discharge port 43 to dry the interiors of the modules 50, 60 provided in the cabinet, a fan 46 provided inside the housing 44 for moving air from the suction port 41 to the first discharge port 42 or to the second discharge port 43, and a vane 47 to direct the air flowing in the housing 44 through the first discharge port 42 or through the second discharge port 43. The air conditioner 40 may further include a heater 45 to heat the air flowing therein.

In this embodiment, the first module (e.g., a lower inner module) 50 may dry utensils that can be used in the bathroom. The first module 50 may dry utensils received therein using hot air discharged from the air conditioner 40. The first module 50 may include a first module drawer 52 movably provided in the cabinet and having a space defined therein, a basket 54 detachably provided in the first module drawer 52, and a rack 56 provided in the basket 54 for holding utensils.

The first module drawer 52 may be slidable along the rail 134 (see FIG. 6) provided in the inner cabinet 100 in forward and rearward directions. The interior of the first module drawer 52 may be hollow, and the top of the first module drawer 52 may be open. Consequently, the basket 54 may be inserted or removed through the open top of the first module drawer 52.

The first module 50 further includes a first module suction member (or first member suction channel) 58 having therein a suction channel connected to the air conditioner 40 and a first module discharge member (or first module discharge port) 59 having a discharge port for discharging air from the first module 50.

In one embodiment, a residual water suction device, which can be used in the bathroom, may be received in the second module 60. The second module 60 may remove residual moisture from the residual water suction device. The second module 60 may perform other functions, such as charging a rechargeable battery in the residual water suction device or disinfecting components of the residual water suction device.

The residual water suction device, which is received in the second module 60, is a device that removes residual water from the wall of the bathroom by suctioning the same. In this embodiment, the residual water suction device may include a main body having a suction module (e.g., a suction fan motor) for suctioning a fluid, a liquid-gas separator connected to the main body for separating the suctioned fluid into gas and liquid, and a suction nozzle having a suction port for suctioning the fluid through the operation of the suction module.

In one embodiment, the residual water suction device may be divided into the suction nozzle, the liquid-gas separator, and the main body. The second module 60 may receive, therein, the separated suction nozzle, liquid-gas separator, and main body of the residual water suction device in order to dry the suction nozzle, the liquid-gas separator, and the main body.

The second module 60 may have therein a plurality of receiving spaces to receive the separate components of the residual water suction device. The second module 60 may include a second module drawer 62, which is movably provided in the cabinet and which defines a plurality of reception units for receiving the separate components of the residual water suction device, and a plurality of fans (not shown) for moving air to the respective reception units. The second module drawer 62 is slidable along the rail 134 provided in the inner cabinet 100 in the forward and rearward directions.

The second module 60 may include a front cover 66 provided at the front of the second module drawer 62 and a second module drawer handle 68 protruding from the upper end of the front cover 66. The front cover 66 may be positioned over a portion of the open front of the inner cabinet 100. In one example, the front cover 66 of the second module 60 may also cover the front of the third module 70 provided above the inner cabinet 100.

The third module 70 may be provided between the inner cabinet 100 and the wash bowl 22. The third module 70 may be provided in a space defined by the upper side of the inner cabinet 100 and the lower side of the wash bowl 22. The third module 70 may be provided in a space defined by the curved bottom of the wash bowl 22 and the upper surface 102 of the inner cabinet 100.

The third module 70 may be provided under an upper cover 80. The upper cover 80 may protrude forward of the third module 70. The upper cover 80 may help prevent water falling from the wash bowl 22 from being introduced into the space in which the third module 70 is received.

The third module 70 may be provided inside the front cover 66 of the second module 60. The third module 70 can be withdrawn when the second module 60 has been withdrawn forward.

The third module 70 may include a third module drawer 72, which is movably provided between the inner cabinet 100 and the wash bowl 22 and which has, therein, a plurality of storage spaces, and a front part (or front wall) 74 that covers the front surface of the drawer.

A plurality of storage spaces may be provided in the third module drawer 72. The storage spaces of the third module drawer 72 may receive a purification filter 76 that purifies the water that is supplied to the water supply valve 24, a temperature controller that controls the temperature of the water that is supplied to the water supply valve 24, a printed circuit board (PCB) or other circuitry that controls the operation of the first module 50 or the second module 60, or a converter for converting alternating current (AC) electric power (e.g., from a power utility) to direct current (DC) electric power to drive one or more of the modules or the air conditioner 40.

In an embodiment shown in the drawings, the washstand furniture 10 may include an upper cover 80 provided between the wash bowl 22 and the cabinet to block and redirect water falling from the wash bowl 22. In this embodiment, the washstand furniture 10 may include an input unit (or user interface) 82 that allows a user to input a command for operating the air conditioner 40 or the modules. The input unit may further output information regarding the operation of the air conditioner 40 or the modules. In this embodiment, the input unit 82 may be provided at one side of the upper cover 80.

In this embodiment, the washstand furniture 10 further includes legs 84 that space a bottom surface of the cabinet apart from the floor of the bathroom by a predetermined distance.

Figure 3:
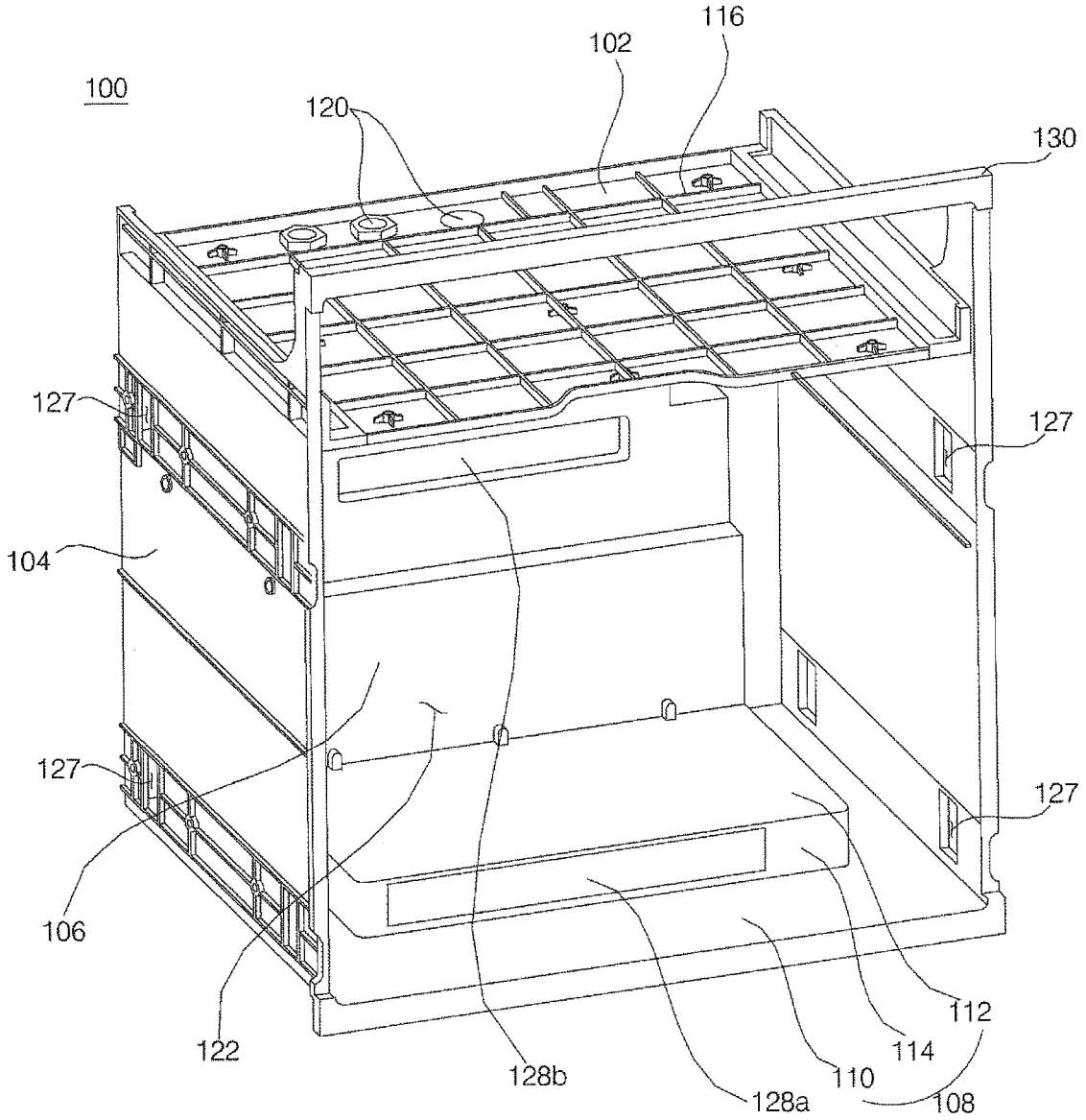
FIG. 3 is a perspective view showing an inner cabinet according to an embodiment of the present disclosure.
Figure 4:
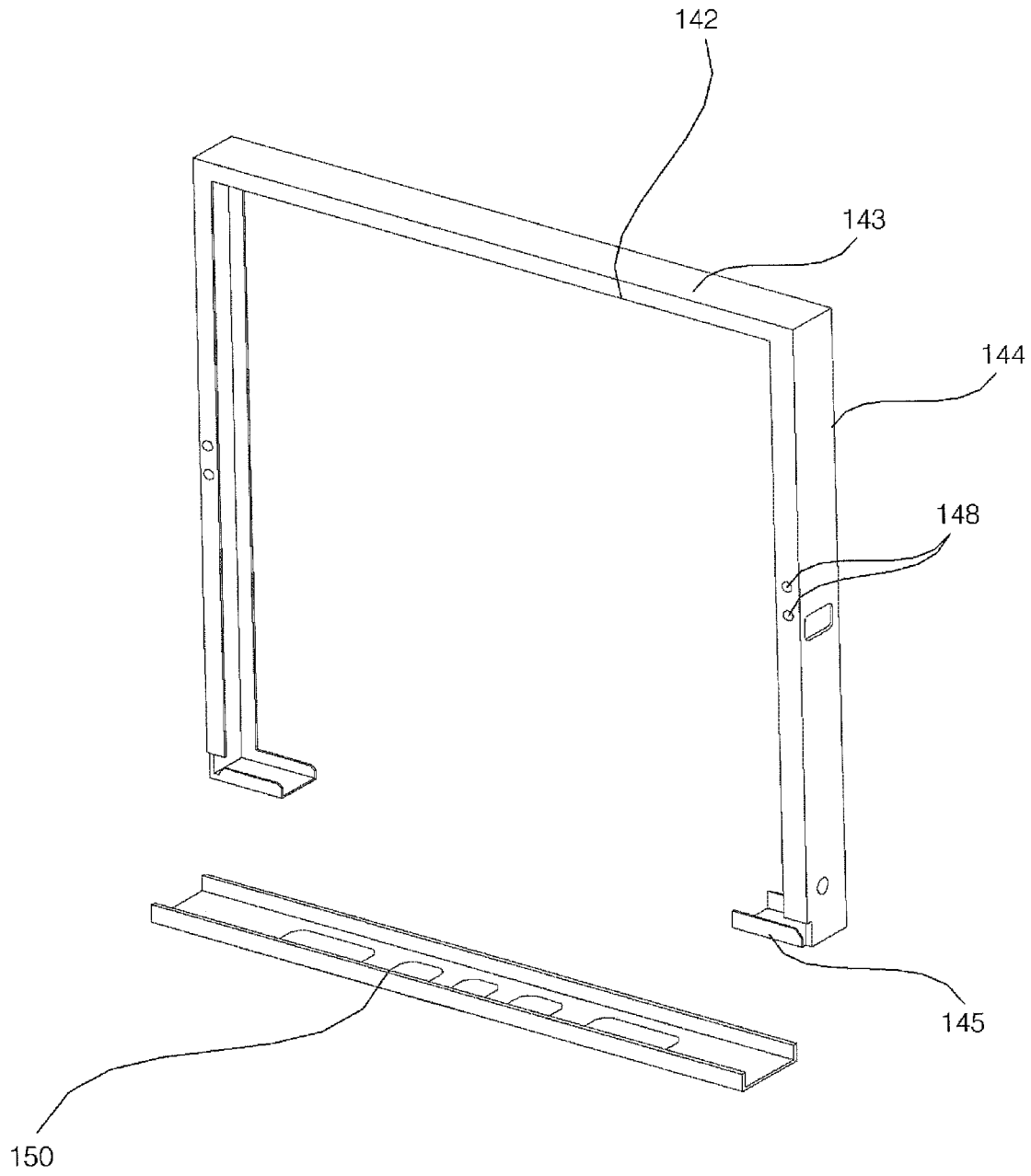
FIG. 4 is a view showing a frame according to an embodiment of the present disclosure.
Figure 5:
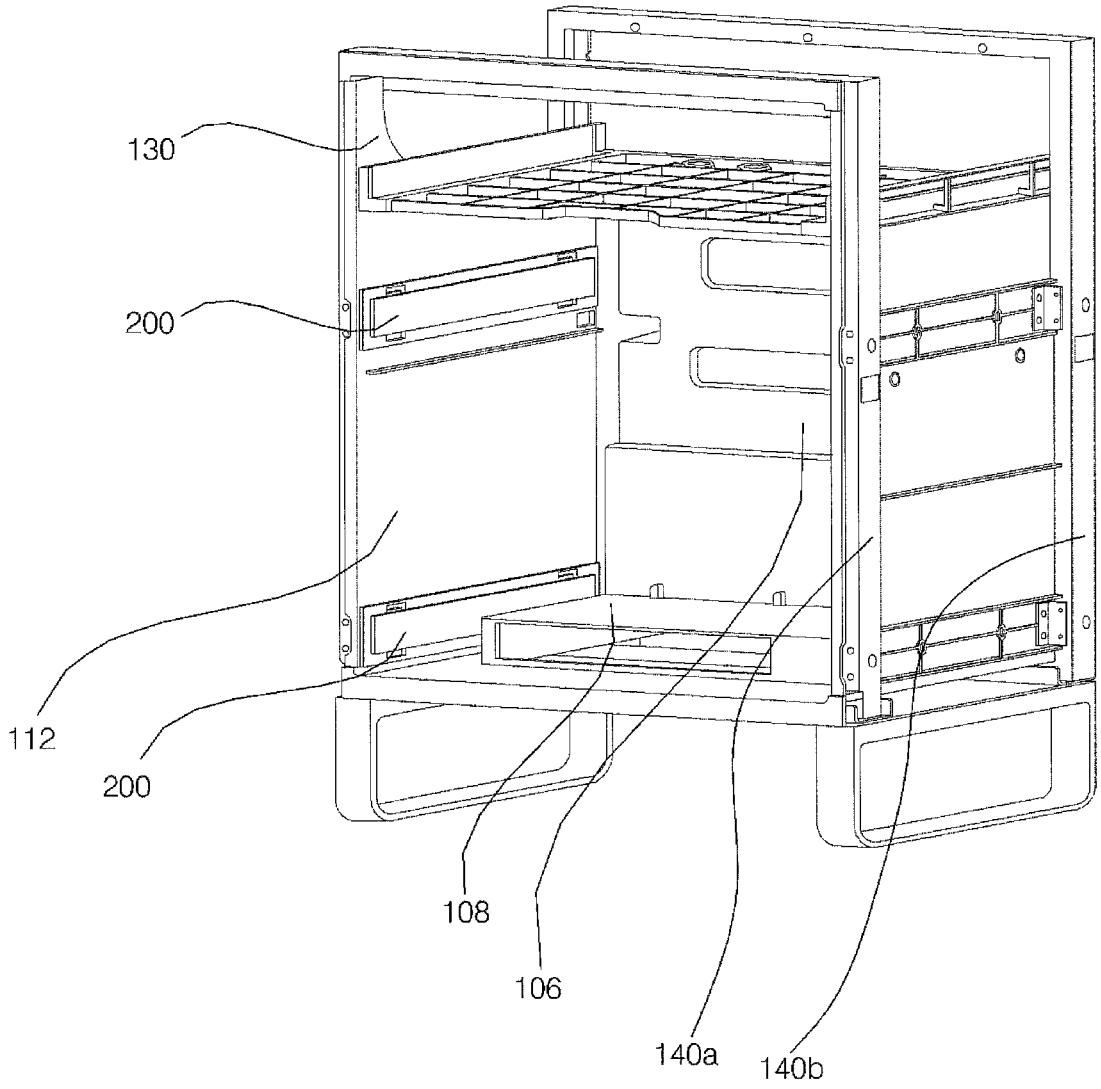
FIG. 5 is a view showing the state in which the inner cabinet, the frame, and a rail bracket according to an embodiment of the present disclosure are coupled to each other.
Figure 6:
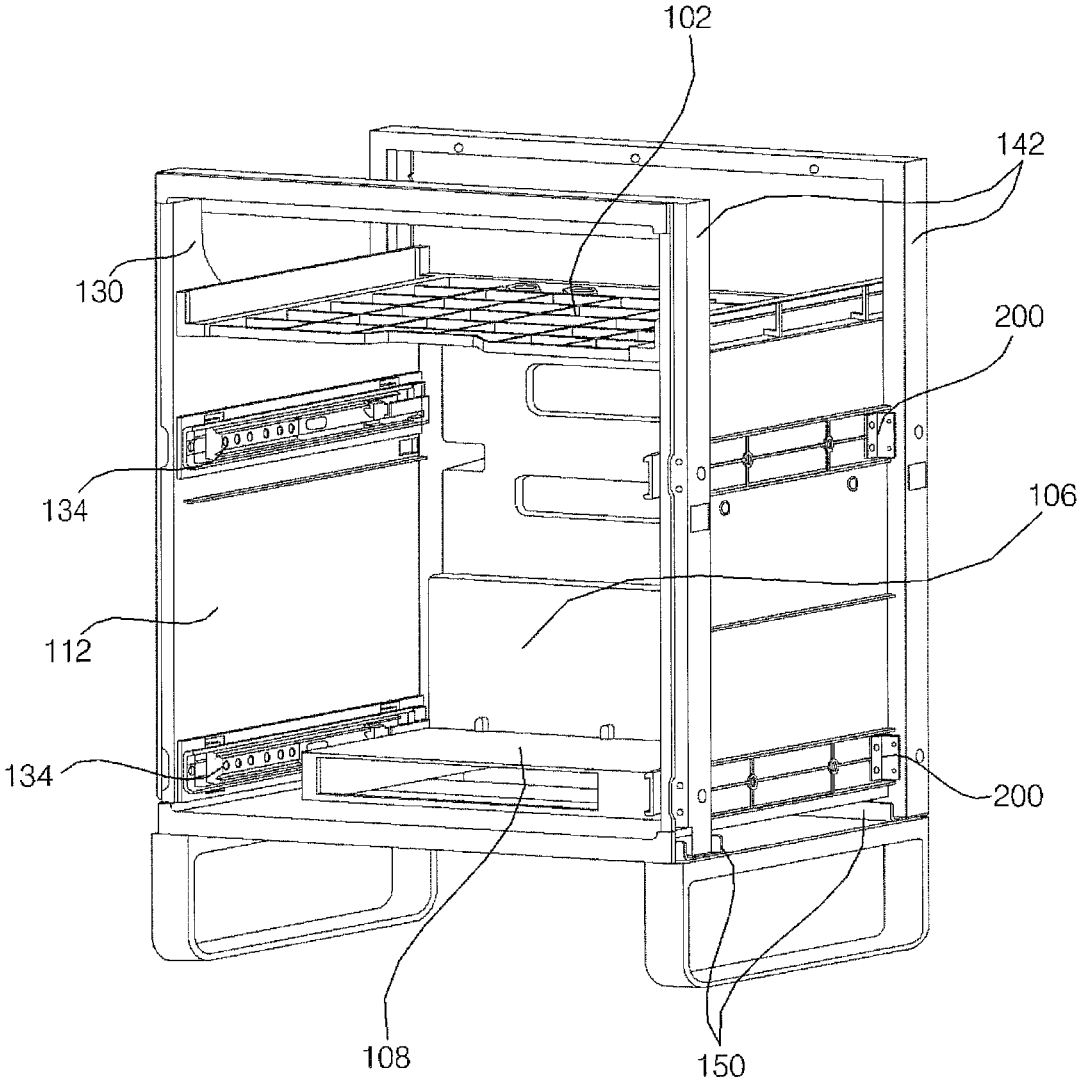
FIG. 6 is a view showing the state in which a rail is mounted to the structure of FIG. 5.
Figure 7:
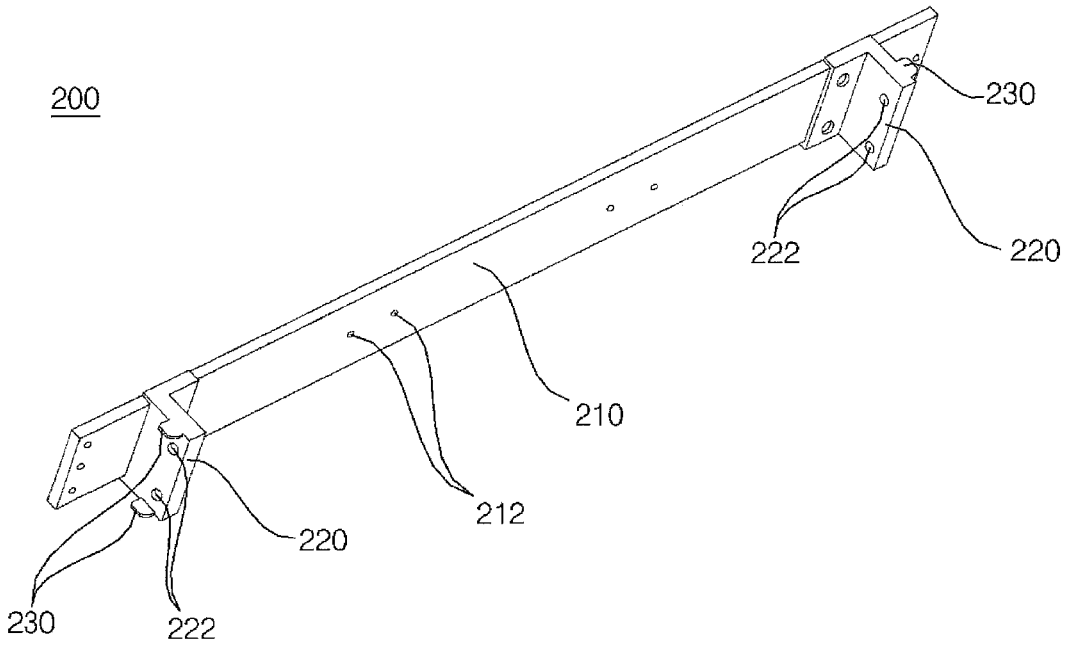
FIG. 7 is a perspective view showing the rail bracket according to the embodiment of the present disclosure.
Figure 8:
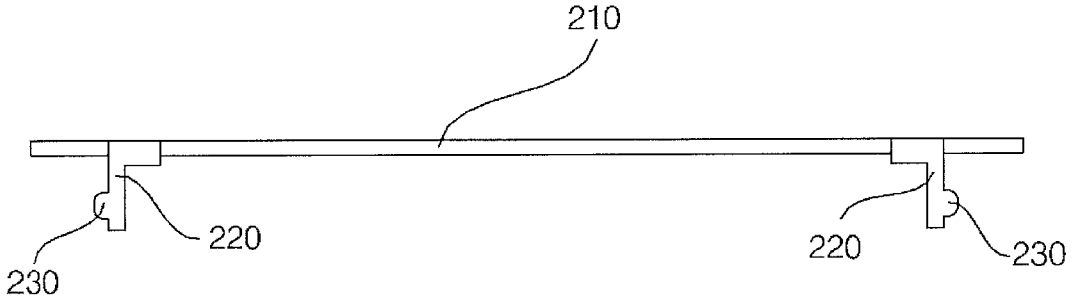
FIG. 8 is a plan view of FIG. 7.
Figure 9:
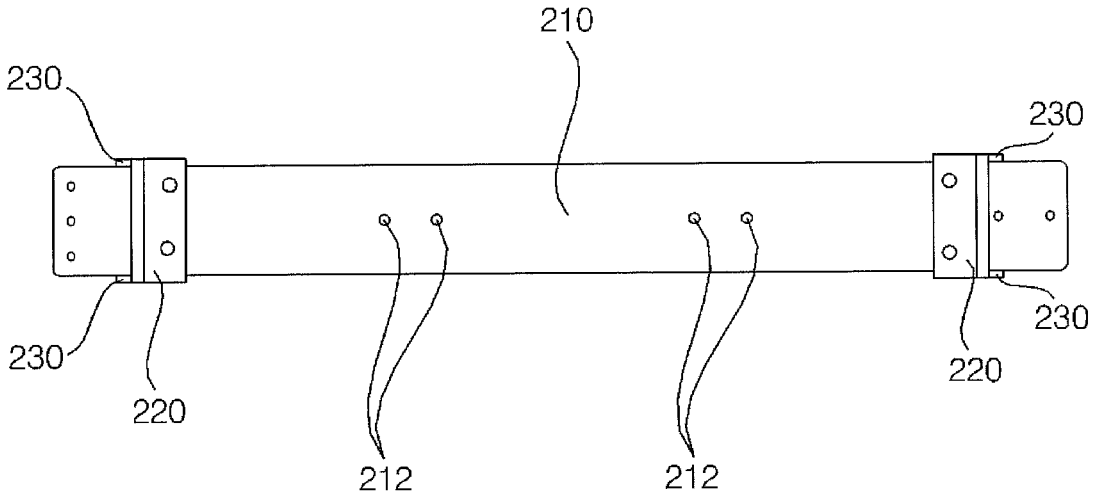
FIG. 9 is a front view of FIG. 7.
Figure 10:
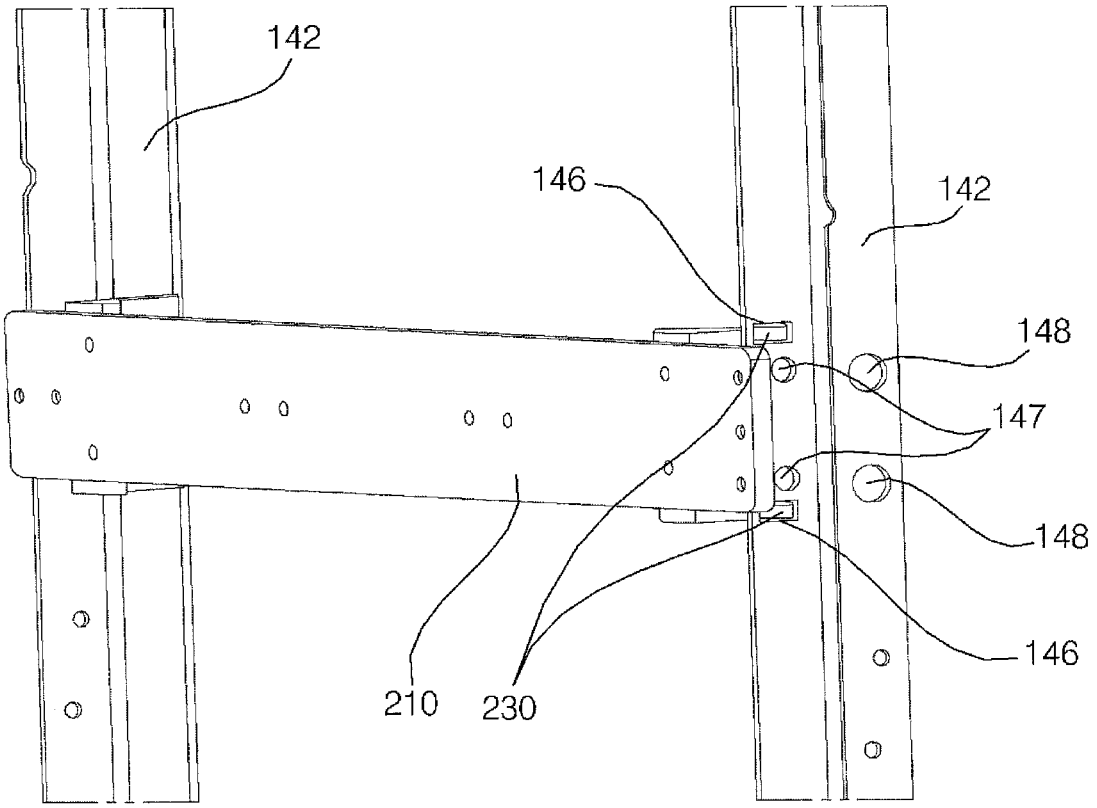
FIG. 10 is a view showing the coupling between the frame and the rail bracket according to the embodiment of the present disclosure.
Figure 11:
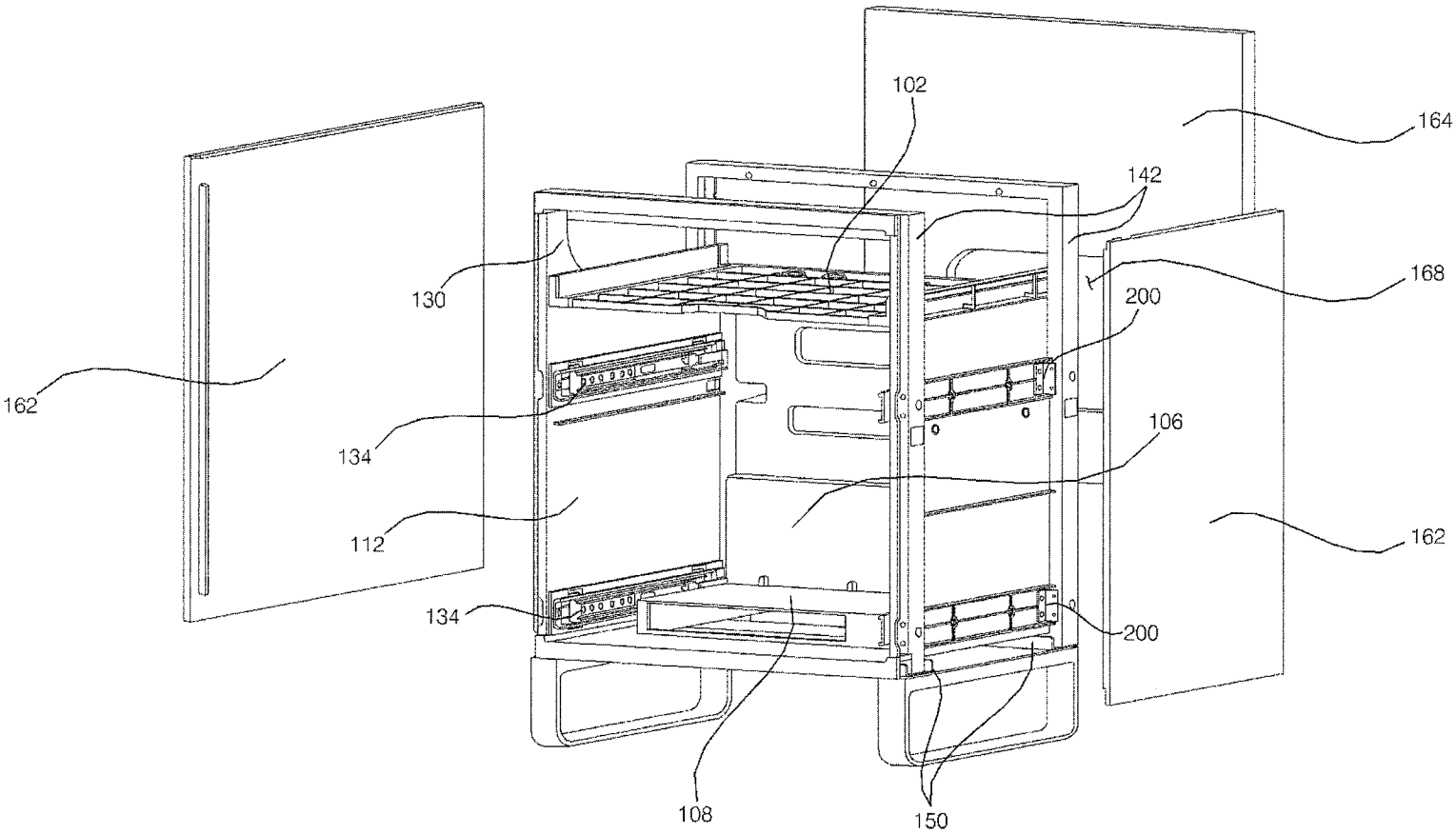
FIG. 11 is a view showing the state in which an outer cabinet is coupled to the structure of FIG. 6.

FIG. 3 is a perspective view showing an inner cabinet according to an embodiment of the present disclosure, and FIG. 4 is a view showing a frame according to an embodiment of the present disclosure. FIG. 5 is a view showing the state in which the inner cabinet, the frame, and a rail bracket according to an embodiment of the present disclosure are coupled to each other, and FIG. 6 is a view showing the state in which a rail is mounted to the structure of FIG. 5. FIG. 7 is a perspective view showing the rail bracket according to the embodiment of the present disclosure, FIG. 8 is a plan view of FIG. 7, and FIG. 9 is a front view of FIG. 7. FIG. 10 is a view showing the coupling between the frame and the rail bracket according to the embodiment of the present disclosure, and FIG. 11 is a view in which the outer cabinet is coupled to the structure of FIG. 6. Hereinafter, the inner cabinet, the frame, the rail bracket, and the outer cabinet according to certain embodiments will be described with reference to FIGS. 3 to 11.

The inner cabinet 100, which is provided under the wash device, has a space therein to receive the modules. The inner cabinet 100 partitions a space to receive the modules and another space that receives the water supply and drainage devices from each other.

The inner cabinet 100 may be formed in the shape of a hollow box. In one embodiment, the inner cabinet 100 is formed in the shape of a box that is open at the front thereof. The modules may be inserted into the inner cabinet 100 through the open front thereof.

The inner cabinet 100 may be provided at one side thereof with a lattice type reinforcement-projecting part (or reinforcement-projecting brace) 116 to maintain the rigidity of the inner cabinet 100. In one embodiment, the lattice type reinforcement-projecting part 116 to maintain the rigidity of the inner cabinet 100 may be provided at an upper surface 102 of the inner cabinet 100. An upper cover 118 for covering the upper side of the inner cabinet 100 at which the reinforcement-projecting part 116 is formed may be provided at the upper surface 102 of the inner cabinet 100. Holes 120, through which the drainage pipe 30 and the water supply hose 26 extend, may be formed in the rear side of the upper surface 102 of the inner cabinet 100.

The rear surface 106 of the inner cabinet 100 may be bent vertically downward from the part thereof that is spaced apart inward from the rear end of the upper surface 102. A module reception unit (or module receiving space) 122 to receive the modules 50, 60 may be formed in front of the rear surface 106, and an external connection unit (or external connection space) 124, which may include a channel connected to the outside, may be formed at the rear of the rear surface 106.

In this embodiment, the modules may be received in the module reception unit 122 of the inner cabinet 100. In this embodiment, a portion of the water supply hose 26 and the drainage pipe 30 may be provided in the external connection unit 124 of the inner cabinet 100, such as to the rear of the module reception unit 122. One or more modules may be received in the module reception unit 122. In this embodiment, the first module 50 and the second module 60 may be received in the module reception unit 122 of the inner cabinet 100. It should be appreciated the fewer, more, or different modules may be received in the module reception unit 122

The washstand furniture 10 may include a rail 134 to guide a movement the modules 50, 60 received in the module reception unit 122 of the inner cabinet 100 in the forward and rearward directions. In this embodiment, the rail 134 may be provided inside the inner cabinet 100. The rail 134 may be mounted to the inner cabinet 100 via a rail bracket 200, which will be described below.

A part of the inner cabinet 100 at which the rail bracket 200 is mounted may include a bracket through-hole 127 to which the rail bracket 200 is fixed. A frame connection part (or frame connection extension) 220 of the rail bracket 200 may extend through the bracket through-hole 127 in the inner cabinet 100. The frame connection part 220, which is connected to the frame 140, may extend outward from the inner cabinet 100 through the bracket through-hole 127 in the inner cabinet 100. In addition, the rail bracket 200 may be fixed to the inner cabinet 100 through the bracket through-hole 127.

A partition block 126 (see FIG. 2) may be provided in the module reception unit 122 of the inner cabinet 100 in order to partition a space in which the first module 50 is provided and a space in which the second module 60 is provided from each other. In this embodiment, the first module 50 and the second module 60 may be vertically separated in the module reception unit 122 by the partition block 126. In one example, the partition block 126 may supply electric power to the modules 50, 60.

In this embodiment, the air conditioner 40, which discharges air to the module reception unit 122 of the inner cabinet 100 in order to dry the floor of the bathroom or to dry the interior of the first module 50, may be provided at the lower side of the inner cabinet 100.

The inner cabinet 100 is provided in at least one surface thereof with communication holes 128 and 129, through which air in the modules received therein flows to the outside of the inner cabinet 100. In this embodiment, the inner cabinet 100 may include the rear surface 106 having the communication holes 128, 129, through which the interiors of the modules 50, 60 communicate with the external connection unit 124. The communication holes 128, 129 may include introduction holes 128*a* and 128*b* that introduce air into the modules and discharge holes 129*a* and 129*b* that discharge the air from the modules.

In this embodiment, the inner cabinet 100 may include the lower surface 108 or the rear surface 106 that have introduction holes 128*a* and 128*b* or discharge holes 129*a* and 129*b*. In this embodiment, the inner cabinet 100 may have, in the rear surface 106 thereof, a discharge hole 129*a* that discharges air from the first module 70, an introduction hole 128*b* that introduces air into the second module 60, and a discharge hole 129*b* that discharges the air from the second module 60. The inner cabinet 100 may further include, in the lower surface 108 thereof, an introduction hole 128*a* that introduces air into the first module 50.

The lower surface 108 of the inner cabinet 100 includes a first lower surface 110, a second lower surface 112 spaced apart from the first lower surface 110 toward the inside of the inner cabinet 100 so as to provide a space in which the air conditioner 40 is provided, and a connection surface 114 interconnecting the first lower surface 110 and the second lower surface 112. In this embodiment, the connection surface 114 may be perpendicular to the first lower surface 110 and the second lower surface 112.

The air conditioner 40 may be provided under the second lower surface 112. The introduction hole 128*a* to introduce air into the first module 50 may be formed in the connection surface 114. A portion of the air conditioner 40 may extend through the introduction hole 128*a* and in the connection surface 114.

The external connection unit 124 may be a space defined between the rear surface 106 of the inner cabinet 100 and a rear-outer cabinet 164, which will be described below. The external connection unit 124 may be separated from the module reception unit 122. The external connection unit 124 and the module reception unit 122 may be separated from each other with respect to the rear surface 106 of the inner cabinet 100.

The external connection unit 124 may be a space defined between the rear surface 106 of the inner cabinet 100, which is spaced inward by a predetermined distance, and the rear-outer cabinet 164. The external connection unit 124 may be open at the lower part thereof so as to be connected to the outside. The external connection unit 124 may be open at the lower part thereof such that air flowing in the modules is discharged out of the washstand furniture 10.

Under the external connection unit 124, a support member 132 to be provided to maintain the distance between the rear surface 106 of the inner cabinet 100 and the rear-outer cabinet 164. The support member 132 may be provided under the water supply and drainage devices to prevent external foreign matter from being introduced into the water supply and drainage devices.

The inner cabinet 100 may include an upper member (or upper brace) 130, which defines an entrance, through which the third module 70 is inserted. The upper member 130 may protrude upward from the upper surface 102 of the inner cabinet 100. The upper member 130 may be provided in front of the upper surface 102 of the inner cabinet 100. The upper member 130 may extend from opposite sides of the inner cabinet 100. The upper member 130 may contact a frame 140, which will be described below.

The frame 140 may provide support for the washstand furniture 10. The frame 140 may minimize a magnitude of the load of the wash device that is transmitted to the inner cabinet 100. In this embodiment, the frame 140 may be made of a sheet metal material, such as iron, aluminum, another appropriate metal, or an alloy thereof. The frame 140 may increase a rigidity of the washstand furniture 10. The frame 140 may protect the external appearance of the inner cabinet 100.

The frame 140 may interconnect the inner cabinet 100 and the outer cabinet 160. The frame 140 may be provided between the inner cabinet 100 and the outer cabinet 160. The frame 140 may define a space in which a wire provided in the washstand furniture 10 is received.

In this embodiment, the frame 140 includes a front frame 140*a*, which is provided in front of the inner cabinet 100, and a rear frame 140*b*, which is provided at the rear of the inner cabinet 100. The front frame 140*a* may surround the outside of the upper member 130 of the inner cabinet 100.

The frame 140 may be formed in the shape of a quadrangular ring that surrounds the circumference of the inner cabinet 100. The frame 140 may contact the side surface 104 and the lower surface 108 of the inner cabinet. In this embodiment, the frame 140 is connected to the wash bowl via the upper cover 80 at the upper side thereof.

The frame 140 supports the load of the wash device. The frame 140 may include a main frame 142 that supports the wash bowl 22 and a subframe 150 that interconnects opposite ends, which are open, of the lower side of the main frame 142. The main frame 142 may be formed in the shape of a quadrangular ring that is open at the lower side thereof. The main frame 142 and the subframe 150 may be coupled to each other at the lower side of the inner cabinet 100.

The main frame 142 may include an upper bar 143, which is connected to the wash bowl 22, a pair of side bars 144 bent perpendicularly from opposite ends of the upper bar 143 so as to be provided at opposite sides of the inner cabinet 100, and a pair of protruding lower bars 145 bent perpendicularly from the lower ends of the side bars 144 so as to be adjacent to each other. The subframe 150 may be provided at the lower side of the lower surface 108 of the inner cabinet. The subframe 150 may interconnect the protruding lower bars 145 of the main frame 142.

The frame 140 may be connected to a base-outer cabinet 166 at the lower side thereof. The frame 140 may be connected to the base-outer cabinet 166 via the legs 84 of the washstand furniture at the lower side thereof. The frame 140 may transmit the load of the wash device to the legs of the washstand furniture.

The frame 140 may be formed in a shape that is capable of supporting the load of the washstand. The frame 140 may be configured to have a space defined therein in the state of being coupled to the inner cabinet 100. In this embodiment, the section of the frame 140 may be formed in the shape of a "[". When the frame 140 is coupled to the inner cabinet 100, therefore, a space through which a wire extends may be formed therebetween.

Referring to FIG. 10, the frame 140 may include, therein, fastening holes 147, through which fastening means, such as bolts, screws, or nails, are inserted such that the frame 140 is fastened to the frame connection part 220 of the rail bracket 200. The frame connection part 220 may be is provided at positions thereof corresponding to the fastening holes 147 with fastening holes 222.

The frame 140 may be further provided with auxiliary holes 148, through which the rail bracket 200 can be easily fastened to the frame 140. The auxiliary holes 148 may be positioned opposite the fastening holes 147. The frame 140 is provided at the part thereof contacting the frame connection part 220 with protrusion recesses 146, into which frame-fixing protrusions 230 are inserted.

The washstand furniture 10 may include a rail bracket 200 that fixes together the frame 140 and the inner bracket 100 and that fastens a rail 134 to the inside of the inner cabinet 100. Referring to FIG. 5, the rail bracket 200 may be connected to the front frame 140*a*, which is provided in front of the inner cabinet 100, and the rear frame 140*b*, which is provided at the rear of the inner cabinet 100, so as to increase the rigidity of the washstand furniture 10. The rail bracket 200 may be fastened perpendicularly to the frame 140 to increase the rigidity of the washstand furniture 10.

A quantity of the rail bracket 200 may correspond in number to the rail 134 provided in the inner cabinet 100. Referring to FIG. 6, the washstand furniture 10 according to this embodiment may include two pairs of rails 134 and two pairs of rail brackets 200 that slidably move the first module 50 and the second module 60 provided in the inner cabinet 100.

The rail brackets 200 may be provided inside the inner cabinet 100. The rail brackets 200 may be provided at opposite inner sides of the inner cabinet 100, in which the first module 50 and the second module 60 are provided.

Each of the rail brackets 200 may include a rail-fastening part (or rail-fastening bar) 210 provided inside the inner cabinet 100 to fasten a corresponding one of the rails 134 and a pair of frame connection parts (or connection extension) 220 protruding perpendicularly from the rail-fastening part 210 so as to be fastened to the frame 140, which is provided outside the inner cabinet 100. The rail bracket 200 may include frame-fixing protrusions 230 that fix the frame connection parts 220 to the frame 140.

Referring to FIGS. 7 to 9, in this embodiment, each rail bracket 200 may include the rail-fastening part 210, two frame connection parts 220, and four frame-fixing protrusions 230. The frame connection parts 220 may be connected to the front frame 140*a* and the rear frame 140*b*. At least one frame-fixing protrusion 230 may protrude from each of the frame connection parts 220. In this embodiment, two frame-fixing protrusions 230 may protrude from each of the frame connection parts 220.

In this embodiment, the rail-fastening part 210 may be formed in the shape of a flat bar. The rail-fastening part 210 may be provided inside each side of the inner cabinet 100. The rail-fastening part 210 may include a plurality of fastening holes 212. The rail-fastening part 210 may fasten the rail 134 to the inside of the inner cabinet 100 using fasteners, such as bolts, screws, nails, rivets, adhesives, etc.

One surface of the rail-fastening part 210 may be substantially flat so as to be fastened to the rail 134, and the frame connection parts 220 may protrude from the other surface of the rail-fastening part 210. One surface of the rail-fastening part 210 may be in contact with the rail 134, and the other surface of the rail-fastening part 210 may be in contact with the inner cabinet 100. The rail-fastening part 210 may be provided perpendicularly from the frame 140 to increase the rigidity of the washstand furniture 10.

The frame connection parts 220 may protrude perpendicularly from the other surface of the rail-fastening part 210. In this embodiment, the frame connection parts 220 may be formed so as to be separated from the rail-fastening part 210. Alternatively, the frame connection parts 220 may be integrally formed with the rail-fastening part 210.

Each frame connection part 220 may be connected to the frame 140, which is provided outside the inner cabinet 100, through the bracket through-hole 127, which is formed in the inner cabinet 100. In this embodiment, the frame connection part 220 may include, at the part thereof contacting the frame 140, fastening holes 222, into which fasteners, such as bolts, screws, rivets, nails, etc. are inserted in order to fasten the frame connection part 220 to the frame 140.

The frame connection part 220 may include a first frame connection part, which is connected to the front frame 140*a*, and a second frame connection part, which is connected to the rear frame 140*b*. The rail bracket 200 may be fastened to the front frame 140*a* and to the rear frame 140*b* via the two frame connection parts 220 to increase the rigidity of the washstand furniture 10.

The frame-fixing protrusions 230 may protrude perpendicularly from the frame connection parts 220, which contact the frame 140, toward the frame 140. The frame-fixing protrusions 230 may be inserted into the protrusion recesses 146, which are formed in the frame 140. The frame-fixing protrusions 230 may increase the fastening force between the rail bracket 200 and the frame 140. In this embodiment, two frame-fixing protrusions 230 may be formed at each frame connection part 220. Alternatively, one frame-fixing protrusion 230 or three or more frame-fixing protrusions 230 may be formed.

The outer cabinet 160 may be provided outside the inner cabinet 100. The outer cabinet 160 may prevent water or moisture from being introduced into the modules received in the inner cabinet 100. The outer cabinet 60 may be fastened to the frame 140. The outer cabinet 160 may be made of a sheet metal material to increase the rigidity of the washstand furniture 10.

A washstand housing according to this embodiment doubly blocks water or moisture from the washstand or the outside. In the washstand housing according to this embodiment, the outer cabinet 160 primarily blocks external water or moisture, and the inner cabinet 100 secondarily blocks the external water or moisture. Referring to FIG. 11, the outer cabinet 160 may include a side-outer cabinets (or side-outer cabinet walls) 162 provided at opposite side surfaces of the inner cabinet 100, a rear-outer cabinet (or rear-outer cabinet wall)164 provided adjacent to the rear surface 106 of the inner cabinet 100, and a base-outer cabinet (or base-outer cabinet wall) 166 provided at the lower surface 108 of the inner cabinet 100.

The side-outer cabinets 162 may be connected to the frame at the opposite side surfaces of the inner cabinet 100. The side-outer cabinet 162 may cover the outside of the inner cabinet and increase the rigidity of the washstand furniture 10.

The external connection unit 124 may be defined between the rear-outer cabinet 164 and the rear surface 106 of the inner cabinet 100. The rear-outer cabinet 164 may be provided in one side thereof with a through-hole 168, through which the drainage pipe 30 of the drainage assembly or the water supply hose 26 of the water supply assembly extends.

The base-outer cabinet 166 may block water or moisture introduced from the bottom of the washstand furniture 10. A space in which the air conditioner 40 is provided may be defined between the base-outer cabinet 166 and the lower surface 108 of the inner cabinet 100.

As is apparent from the above description, the washstand furniture according to the present disclosure has the following aspects. First, the rails may be mounted inside the inner cabinet, and the inner cabinet is fixed to the frame via the rail brackets, whereby it is possible to easily move the modules received in the inner cabinet in a sliding fashion. Second, the rail brackets may be connected perpendicularly to the frame provided at the front and rear of the inner cabinet, whereby it is possible to maintain the rigidity of the washstand furniture and thus to stably control the modules received in the inner cabinet.

It is an aspect of the present disclosure to provide washstand furniture having a stable structure that is capable of supporting a washstand while a storage space defined therein is conveniently used. It is another aspect of the present disclosure to provide washstand furniture that is capable of stably supporting a washstand while having a storage space defined therein. The aspects of the present disclosure are not limited to the above-mentioned aspects, and other aspects that have not been mentioned above will become evident to those skilled in the art from the following description.

In accordance with the present disclosure, the above and other aspects can be accomplished by the provision of washstand furniture including: a wash device including a wash bowl, a water supply assembly for supplying water to the wash bowl, and a drainage assembly for draining the water supplied to the wash bowl; an inner cabinet provided under the wash bowl, the inner cabinet having a space defined therein; a frame provided outside the inner cabinet for supporting the load of the wash device; an electrically operated module provided in the inner cabinet; a rail for moving the module provided in the inner cabinet; and a rail bracket for fastening the rail to the inside of the inner cabinet and for fixing the inner cabinet and the frame, whereby the washstand furniture is supported by the frame and the rail bracket.

The rail bracket may include a rail-fastening part for fastening the rail to the inside of the inner cabinet; a frame connection part protruding from the rail-fastening part toward the outside of the inner cabinet so as to be fastened to the frame, which is provided outside the inner cabinet; and a frame-fixing protrusion protruding from the frame connection part toward the frame such that the frame connection part is fixed to the frame. Consequently, the rail bracket may be provided inside the inner cabinet to fix the frame, which is provided outside the inner cabinet.

The frame may include a front frame, which is provided in front of the inner cabinet, and a rear frame, which is provided at the rear of the inner cabinet, and the rail bracket is connected to the front frame and to the rear frame. The rail bracket may be provided so as to be perpendicular to the frame. Consequently, the washstand furniture may have a lattice structure.

Those skilled in the art will appreciate that the present disclosure may be carried out in specific ways other than those set forth herein without departing from the spirit and essential characteristics of the present disclosure. The above embodiments are therefore to be construed in all aspects as illustrative and not restrictive. The scope of the disclosure should be determined by the appended claims and their legal equivalents, not by the above description, and all changes coming within the meaning and equivalency range of the appended claims are intended to be embraced therein.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. Washstand furniture comprising:

a wash bowl;

a faucet that supplies water to the wash bowl;

a drain to remove the water supplied to the wash bowl;

an inner cabinet provided under the wash bowl, the inner cabinet having a space defined therein;

a frame provided outside the inner cabinet to support a load of the wash bowl;

an electrically operated module provided in the space in the inner cabinet;

a rail that enables the module to move in or out of the inner cabinet; and a rail bracket that fastens the rail to an interior of the inner cabinet and fixes together the inner cabinet and the frame, wherein the rail bracket includes:

a rail-fastening bar provided inside the inner cabinet so as to be fastened to the rail; and a frame connection extension protruding from the rail-fastening bar toward an outside of the inner cabinet so as to be fastened to the frame, which is provided outside the inner cabinet, and wherein the inner cabinet includes a bracket through-hole, through which the frame connection extension extends.

2. The washstand furniture according to claim 1, wherein the frame connection extension protrudes perpendicularly from the rail-fastening bar.

3. The washstand furniture according to claim 1, wherein the rail bracket includes a frame-fixing protrusion that extends from the frame connection extension and toward the frame, and the frame, at a location contacting the frame connection extension, includes a protrusion recess into which the frame-fixing protrusion is inserted.

4. The washstand furniture according to claim 1, wherein the frame includes a front frame, which is provided at a front of the inner cabinet, and a rear frame, which is provided at a rear of the inner cabinet, and the rail bracket is connected to the front frame and to the rear frame.

5. The washstand furniture according to claim 4, wherein the rail bracket is included in a plurality of rail brackets provided in the inner cabinet, and each of the plurality of rail brackets is connected to the front frame and to the rear frame.

6. The washstand furniture according to claim 4, wherein the rail bracket includes:

a rail-fastening bar provided inside the inner cabinet so as to be fastened to the rail;

a first frame connection extension protruding from the rail-fastening bar so as to be fastened to the front frame; and a second frame connection extension protruding from the rail-fastening bar so as to be fastened to the rear frame.

7. The washstand furniture according to claim 1, wherein the rail bracket is oriented perpendicular to the frame.

8. The washstand furniture according to claim 1, wherein the frame is formed in a shape of a quadrangular ring that is positioned around a circumference of the inner cabinet.

9. The washstand furniture according to claim 1, further comprising an outer cabinet fastened to the frame so as to cover an outside of the inner cabinet.

10. The washstand furniture according to claim 9, wherein the outer cabinet includes:

a side-outer cabinet walls that cover a corresponding side surfaces of the inner cabinet;

a rear-outer cabinet wall that covers a rear surface of the inner cabinet; and a base-outer cabinet wall that covers a lower surface of the inner cabinet.

11. The washstand furniture according to claim 9, wherein an external connection channel that provides air communications between the space in the inner cabinet and an exterior of the washstand furniture is defined between the rear-outer cabinet wall and a rear surface of the inner cabinet.

12. The washstand furniture according to claim 1, wherein the module further includes a drawer that is movably provided in the inner cabinet and defines the plurality of receiving recesses to receive the separate components of a residual water suction device.

13. The washstand furniture according to claim 12, wherein the module further includes one or more fans that move air to the receiving recesses.

14. The washstand furniture according to claim 1, wherein the inner cabinet includes a communication hole through which air flows into the module.

15. The washstand furniture according to claim 1, wherein
- the module is included a plurality of modules provided in the space in the inner cabinet,
- the rail is included in a plurality of rails in the inner cabinet and that move the modules in the inner cabinet, and
- the rail bracket is included in a plurality of rail brackets that fasten the rails to the interior of the inner cabinet.

16. The washstand furniture according to claim 1, further comprising:
- a dryer provided under the inner cabinet, wherein:
- the dryer provides a heated air flow, and
- the inner cabinet further includes a communication hole directing the heated air flow to the module.

17. The washstand furniture according to claim 1, wherein the inner cabinet includes reinforcement-projecting brace provided at an upper surface of the inner cabinet.

18. The washstand furniture according to claim 1, further comprising a user interface, wherein the module is selectively activated based on an input received via the user interface.

19. The washstand furniture according to claim 1, further comprising an upper cover provided between the wash bowl and the inner cabinet, the upper cover extending forward from a front of the inner cabinet.

20. An apparatus comprising:
- a cabinet provided under a basin having a water supply and a drain, the cabinet having a space defined therein;
- a frame provided outside the cabinet to support a load of the basin;
- an electrically-operated module provided in the space in the cabinet;
- a rail configured to be slidably coupled to the module such that the module can move in or out of the cabinet; and
- a rail bracket that fastens the rail to an interior of the cabinet and fixes together the cabinet and the frame, wherein
- the frame includes a front frame, which is provided at a front of the cabinet, and a rear frame, which is provided at a rear of the cabinet,
- the rail bracket is connected to the front frame and to the rear frame, and
- the rail bracket includes:
  - a rail-fastening bar provided inside the cabinet so as to be fastened to the rail;
  - a first frame connection extension protruding from the rail-fastening bar so as to be fastened to the front frame; and
  - a second frame connection extension protruding from the rail-fastening bar so as to be fastened to the rear frame.

* * * * *